United States Patent [19]

Zimmern

[11] 4,373,866

[45] Feb. 15, 1983

[54] PROCESS TO CONTROL THE DELIVERY OF A SINGLE SCREW COMPRESSOR

[75] Inventor: Bernard Zimmern, Neuilly sur Seine, France

[73] Assignee: Uniscrew Limited, Hamilton, Bermuda

[21] Appl. No.: 158,074

[22] Filed: Jun. 10, 1980

[30] Foreign Application Priority Data

Jun. 18, 1979 [FR] France ..... 79 15484

[51] Int. Cl.[3] ..... F04B 49/02; F04C 18/00; F04C 23/00; F04C 29/10

[52] U.S. Cl. ..... 417/53; 417/288; 417/304; 417/310; 418/97; 418/195

[58] Field of Search ..... 417/53, 287, 288, 304, 417/310, 440; 418/97, 195

[56] References Cited

U.S. PATENT DOCUMENTS

| | | | |
|---|---|---|---|
| 1,634,491 | 7/1927 | Cundy | 417/288 |
| 3,088,658 | 5/1963 | Wagenius | 418/201 |
| 3,295,752 | 1/1967 | Bellmer | 417/310 |
| 3,687,572 | 8/1972 | Glanvall | 417/310 |
| 3,874,828 | 4/1975 | Herschler et al. | 418/87 |
| 4,028,016 | 6/1977 | Keijer | 418/195 |
| 4,042,310 | 8/1977 | Schibbye et al. | 417/310 |
| 4,074,957 | 2/1978 | Clarke et al. | 418/195 |

FOREIGN PATENT DOCUMENTS

| | | |
|---|---|---|
| 2148677 | 3/1973 | France . |
| 2177171 | 11/1973 | France . |

*Primary Examiner*—John J. Vrablik

*Attorney, Agent, or Firm*—Finnegan, Henderson, Farabow, Garrett & Dunner

[57] ABSTRACT

A process to control the delivery of a single screw compressor comprising a screw meshing with two pinion wheels and rotatable inside a casing. A channel with obturating means is provided to connect the high pressure orifice pertaining to a one pinion-wheel and the low pressure orifice. Auxiliary orifices are arranged to connect the various zones of the casing exposed to pressure with the low pressure orifice, said auxiliary orifices being provided with obturating devices. Said orifices are sequentially opened to diminish the delivery, starting from the orifice located near the low pressure orifice. First, the orifices pertaining to the first pinion wheel are sequentially opened. Then, the channel connecting the high pressure orifice of the first pinion and the low pressure orifice is opened. Then, the auxiliary orifices pertaining to the second pinion are sequentially opened.

3 Claims, 9 Drawing Figures

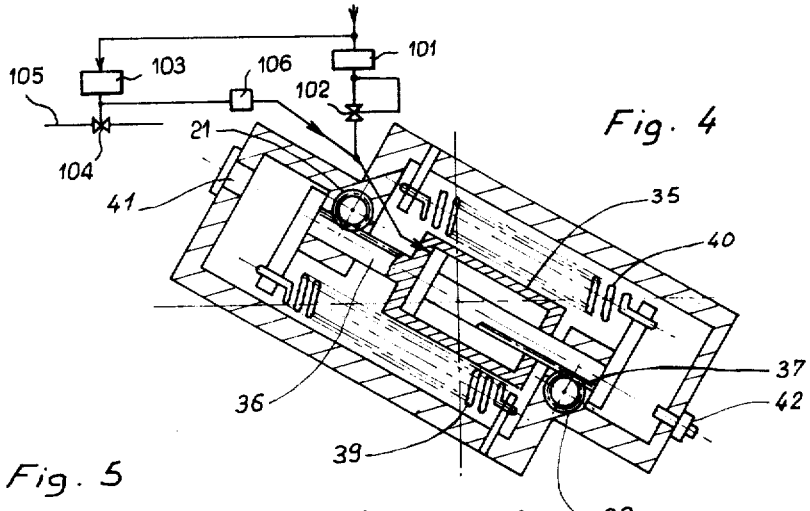
Fig. 4
Fig. 5
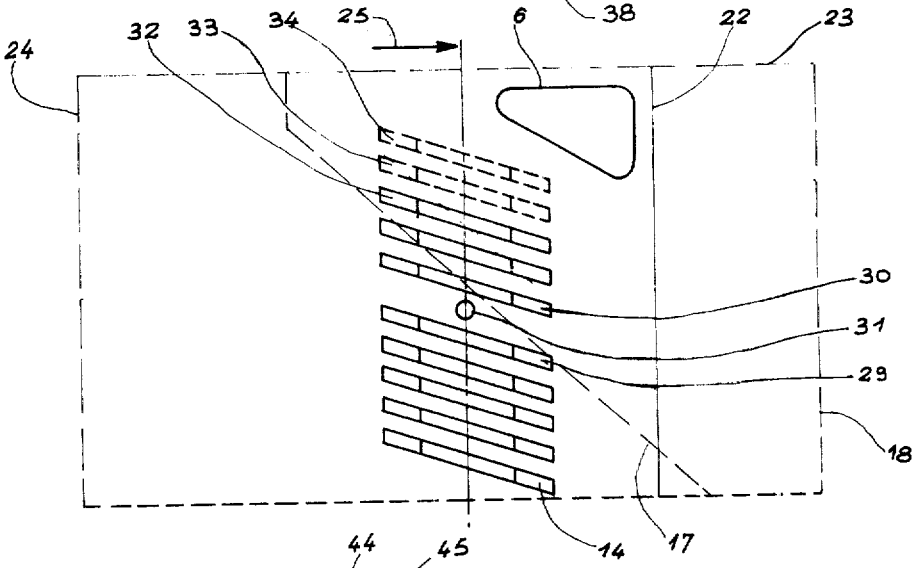
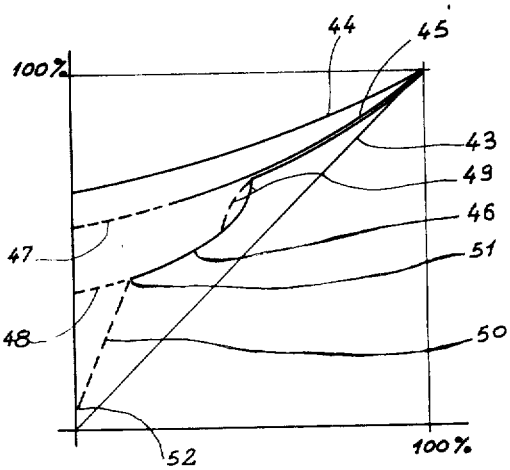
Fig. 6

FIG. 7
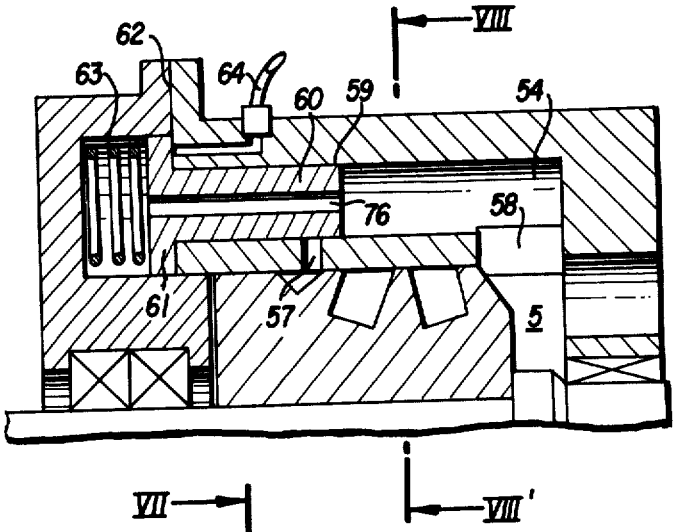
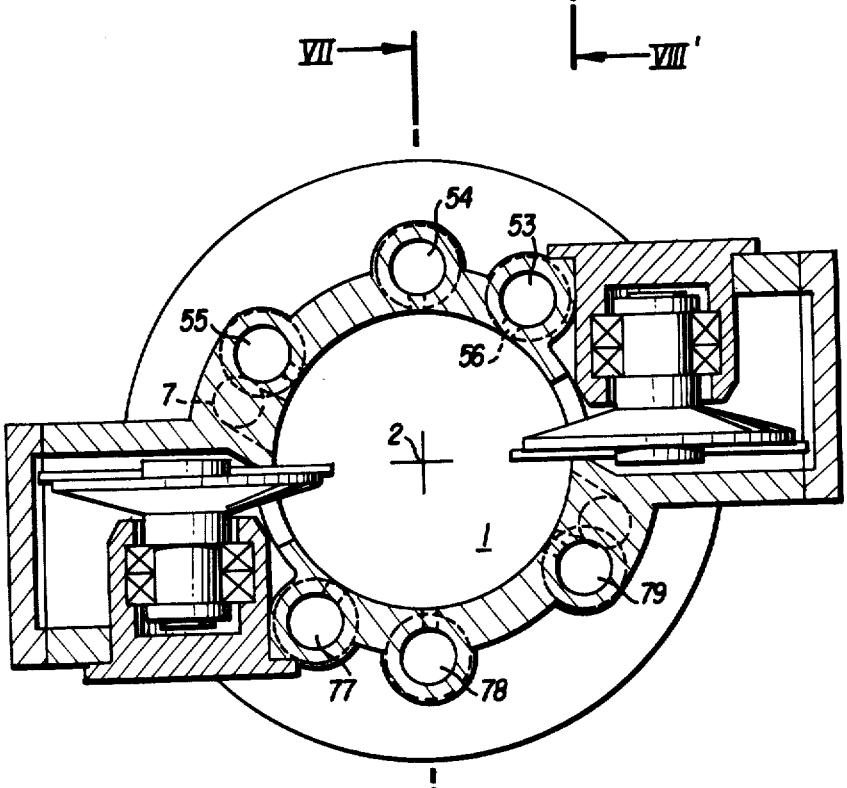
FIG. 8
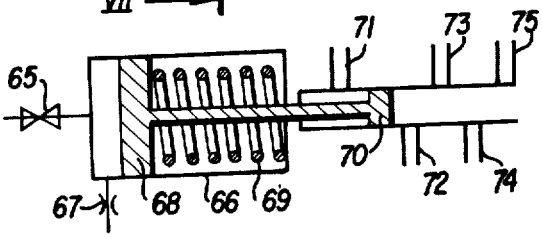
FIG. 9

PROCESS TO CONTROL THE DELIVERY OF A SINGLE SCREW COMPRESSOR

BACKGROUND

1. Field of the Invention

The invention concerns a process for controlling the delivery of single screw compressors.

2. Description of the Prior Art

The control of delivery of single screw compressors or expansion machines comprising a screw meshing with at least one pinion wheel, by moving a part of the casing so as to delay the closing of the threads and to simultaneously delay the connection with the high pressure orifice in order to maintain the compression rate, is known, especially from the French patent application 76/25431, corresponding to French Pat. No. 2,321,613.

This arrangement is nevertheless very expensive because it requires manufacturing portions of the casing that must slide at the very place where one wishes to ensure a very good tightness between the screw and the casing in order to avoid leakages, thus requiring a high accuracy.

It is also known from U.S. Pat. Nos. 3,088,658 and 3,874,828 how to provide a twin-screw compressor with a control device, using orifices that are sequentially connected with the casing by means of a turn valve placed in a bore parallel to the axis of the screws. This arrangement is much less expensive but it has the disadvantage of providing a very bad efficiency at very low operating deliveries because it does not permit to vary the dimension of the high pressure orifice and to maintain the compression rate when the delivery diminishes.

It is also known from the U.S. Pat. No. 3,804,564 to vary the delivery of a single screw compressor by providing orifices in the casing around the screw, the outline of such orifices being inscribed within the width of the top of a thread of the screw, but this solution leads to the same disadvantages as those cited in relation to aforesaid U.S. patents.

SUMMARY OF THE INVENTION

It is an object of the invention to provide a control process which does not offer the aforesaid disadvantages.

According to the invention the process to control the delivery of single screw compressors or expansion machines comprising a screw meshing with at least two pinion wheels and rotatable inside a casing provided with at least one low pressure orifice and high pressure orifices located near the abovementioned pinion wheels, at least one piping means to connect the high pressure orifice pertaining to one pinion, hereinafter called first pinion, to the low pressure orifice, such piping means being provided with obturating means, auxiliary orifices arranged in the casing for connecting the various zones of the casing exposed to the pressure with the low pressure orifices, such auxiliary orifices being provided with obturating means, consists of sequentially opening these orifices so as to reduce the delivered volume, beginning from the orifices at higher pressure. In order to reduce the delivery of the compressor or expansion machine from maximal delivery, the auxiliary orifices pertaining to the first pinion wheel are sequentially opened; if the measured delivery is still too high, the device obturating the piping between the high pressure orifice of the first pinion wheel and the low pressure orifice is then opened; if the delivery so obtained is still too high, the auxiliary orifices pertaining to the second pinion wheel are sequentially opened.

Such a process retains the simplicity of those devices where the obturating means are not in contact with the screw, while maintaining the compression ratio because the compression ratio obtained by said process is, provided the two pinion wheels are symmetrical, approximately equal in the 25 to 50% delivery range and in the 50–100% range—due to cancelling the compression of one of the pinion wheels. This therefore eliminates the major disadvantage normally associated with the devices using auxiliary orifices.

It must also be noted that, if this process results in creating asymmetrical thrusts on the screw, these thrusts are, contrary to what one might think, quite reduced, and of the same order of magnitude as those generated by the traction of a belt in the case of a pulley-and-belt drive applied to industrial air compression. If such a drive is used it is particularly advantageous to arrange the belt traction and the pinion wheels in such a way that the thrusts are opposed and balance each other approximately.

In case the invention is carried out for compression of gases, and especially of air, and the compressor is provided with an injection means of auxiliary liquid, it has been discovered that it was possible to let the compressor run without any delivery during long periods by connecting also the high pressure orifice pertaining to the second pinion wheel to the low pressure orifice, provided the injection is stopped a few moments before connecting the high and low pressure orifices in the case of cylindrical or nearly cylindrical screw.

Additionally this process allows remarkable reduction of power at zero delivery. So, in air compression with discharge pressures around 7 bars, in known compressors provided with a sealing and cooling liquid injection means, a compressor the delivery of which is reduced to zero by throttling its intake consumes 60 to 70% of the full load power.

With a turn valve as described in U.S. Pat. No. 3,088,658, the power compressed is still in the order to 60 to 60%; it must be noted that such valve permits a reduction in delivery to 20–25% approximately and that zero delivery requires intake throttling.

With the process according to the invention, the delivery can be reduced to 10–15% by using the auxiliary orifices. Then, by throttling the intake, a power around 40% at zero delivery is obtained.

But it is possible to reach much lower powers yet, when all orifices pertaining to the second pinion wheel are open, by connecting also the high pressure orifice pertaining to the second pinion wheel with the intake orifice and to stop the liquid injection a few seconds before this connection. The power consumed by the compressor drops to a few percent, and there is no longer need to inject liquid to cool the compressor (such injection would result in considerably increasing the consumed power, around 15 to 20%, and would require providing auxiliary cooling), as the small remaining power is dissipated by natural convection. Apparently the few droplets of liquid remaining in the machine are sufficient to ensure the little lubrication required for the screw-pinion contact, especially when the pinion wheels are realized in a known way with a floating assembly as described in U.S. Pat. No. 3,788,784 and made of a self-lubricating plastic material.

BRIEF DESCRIPTION OF THE DRAWING

This invention will be more easily understood from reading the description hereafter and from the attached drawing, given as a non limitative example, in which:

FIG. 4 is a front view of the device permitting to obtain a sequential operation of the obturating devices of the auxiliary channels, FIG. 5 is a stretched view of the casing enclosing the screw, FIG. 6 is a diagram showing power as a function of delivery, FIG. 7 is a section view along VII—VII' of FIG. 8, of a compressor according to an alternate embodiment of the invention, FIG. 8 is a section view of FIG. 7 along VIII—VIII' of FIG. 7, FIG. 9 is a diagrammatic view showing the device controlling the obturation of the auxiliary channels of the solution of FIGS. 7 and 8.

DESCRIPTION OF THE PREFERRED EMBODIMENT

Figure 1:
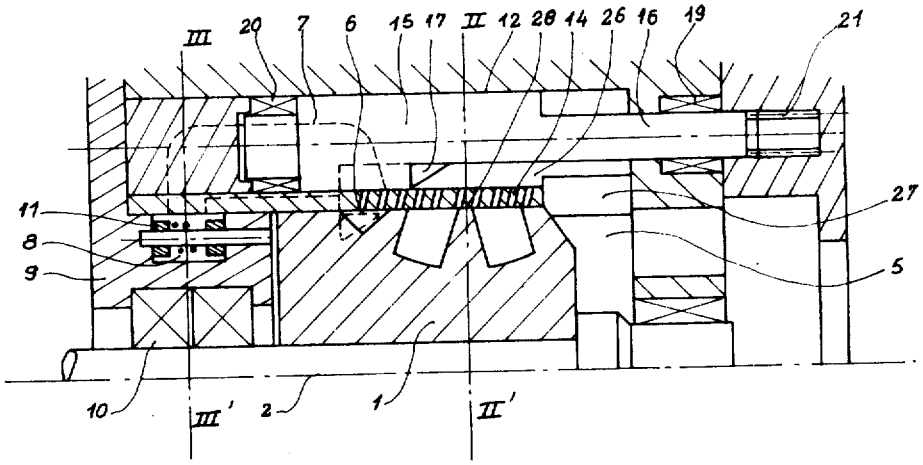
FIG. 1 is a section view through the screw axis of a compressor according to the invention showing especially a first arrangement of the auxiliary channels and of their obturating device, along I—I' of FIG. 2.
Figure 2:
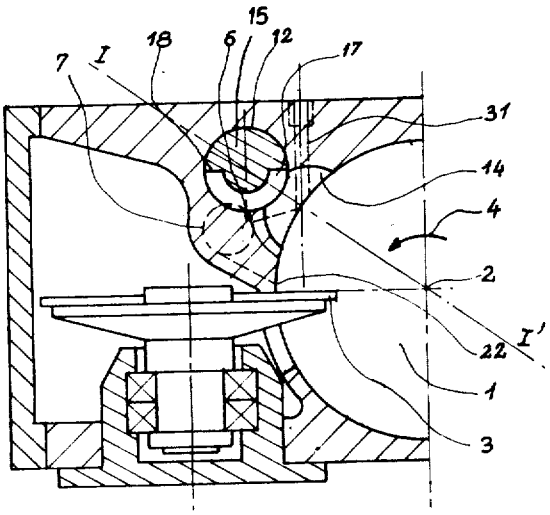
FIG. 2 is a section view along II—II' of FIG. 1.

Referring to FIG. 1, a screw 1 rotatably mounted around the axis 2 meshes with two pinion wheels such as 3, shown in FIG. 2, located substantially symmetrically with respect to axis 2.

When used as a compressor, the screw turns in the direction of arrow 4. The low pressure orifice is located in 5. A high pressure orifice 6 visible as a dotted line in FIG. 1 is located near each pinion such as 3 and the high pressure gas is gathered through a piping means 7 arranged in the casing, brought to a channel 8 formed in the cover 9 fixed upon the casing and which holds the bearings 10 of the screw. Thus this channel collects the compressed gas generated in each half-compressor formed by each pinion wheel and the screw, such gas being conveyed by a discharge line (not shown) towards its place of utilization.

Figure 3:
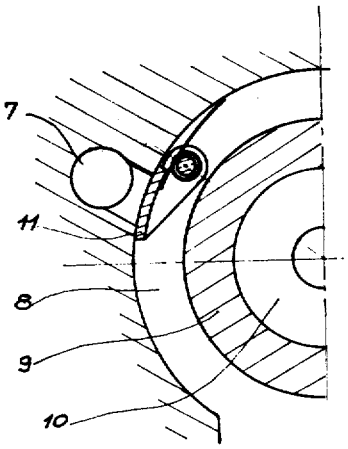
FIG. 3 is a section view taken along III—III' of FIG. 1.

The exhaust pipe 7 pertaining to pinion wheel 3—hereinafter designated as first pinion, whilst the other one (not shown) is designated as second pinion—is provided at its access into channel 8 with a check valve 11 (FIGS. 1 and 3).

The casing of the compressor is also provided with two bores symmetrically located with respect to axis 2 and substantially parallel thereto, one of these bores being visible in 12 in FIGS. 1 and 2. These bores are connected with the inside of the casing by auxiliary orifices such as 14 preferably slot-shaped.

Inside such bores an obturating means 15 is pivotally mounted, which is a helical turn valve, consisting of a cylindrical core 16 around which a solid part is machined limited by a helical surface 17 and by a straight surface parallel to the axis of the bore 18.

This turn valve is mounted on bearings 19 and 20 and can be rotatably driven by the gear 21, driven by a rack.

FIG. 5 is a stretched view of the casing at the place the high pressure orifice 6 and the auxiliary orifices 14 are located. The pinion wheel passes with an extremely reduced clearance near the edge 22 of the casing.

The outline 23 of the turn valve is shown as stretched and located in the cylinder in an arbitrary rotation position, whilst the dotted line 24 shows the edge 18, but transposed by a complete turn of the turn valve.

In a known way, the turn valve in one angular position totally masks the auxiliary orifices 14, then by rotating in the direction of arrow 25 to sequentially unmask the various orifices, starting from those located on the low pressure side.

As soon as one orifice is unmasked, the gas which the screw tends to compress escapes via the auxiliary orifice, passes into space 26 provided between axis 16 and bore 12 and reaches the low pressure orifice through a passage 27 provided in the casing.

The auxiliary orifices 14 are inscribed within the width of the top of the screw threads 28 so that, when the top of the thread passes opposite them, they are completely obturated and that no communication results between two successive threads.

The pitch of the auxiliary orifices is not absolutely regular and the orifices 29 and 30 are sufficiently spaced from each other to allow a passage for a liquid injection channel 31 intended to cool and possibly to seal and lubricate the compressor.

The diameter of the turn valve is so determined relative to that of the screw that one auxiliary orifice is almost fully open before the next begins to unmask, and the last auxiliary orifice 32 on the high pressure side is located sufficiently far from the high pressure orifice 6 so that one thread can not be simultaneously connected with the high pressure orifice and with the auxiliary orifice.

Referring to FIG. 2, the bore 12 intersects the high pressure piping 7 and it is therefore possible, by sufficiently rotating the turn valve, not only to expose the auxiliary orifices 14 but also to connect the high pressure orifice 6 with the low pressure orifice 5.

Instead of connecting the high pressure orifice and the low pressure orifice in this way, it would also be possible to realize this connection by means of supplementary auxiliary orifices such as 33 and 34 arranged in such a way that a thread is simultaneously communicating with orifice 6 and with these complementary orifices.

Referring to FIG. 4, a device permitting to sequentially actuate the two turn valves pertaining to the first and second pinion wheel will now be disclosed. A jack 35 is fed by gas pressurized by the compressor through a first pilot-valve 101 which is provided with a pneumatic lock 102 which is automatically closed when the pressure applied to the jack reaches a value of, say, 5 bars. Provisionally, it will be assumed that said lock is permanently open. Said jack is provided with two racks 36 and 37 respectively attached to the body and to the piston of the jack one of them meshing with the gear 21 of the turn valve 15 pertaining to the first pinion wheel, the other meshing with the gear 38 of the turn valve pertaining to the second pinion wheel.

These two racks are pulled by springs 39 and 40 and their travel is limited by stops 41 and 42. Stiffness of spring 40 is greater than stiffness of spring 39 in such a manner that, first, the body is moved until stop 41 is reached, and then spring 40 begins to expand, thus moving the piston.

The control process which will now be described in the case of an air compressor discharging at 7 bar, with a control range from 7 to 8 bar, such case being taken as a non-restrictive example, is the following.

At compressor start-up, as long as pressure does not reach the nominal pressure of 7 bar, the jack 35 is not supplied with gas.

The racks are in the position shown in FIG. 4 and in these positions all auxiliary orifices pertaining to the first and second pinion wheels are closed by the turn valves. Thus, the compressor operates at full capacity.

If the demand for air decreases, the pressure downstream of the compressor increases and, when it exceeds 7 bar, said pilot valve 101 starts sending an increasing air pressure into the jack 35, which pushes the rack 36, which rotates the turn valve 15, which sequentially exposes the auxiliary orifices of the first pinion wheel, starting from those located on the low pressure side, thereby progressively reducing the delivery of the compressor.

If the delivery is still too great, the turn valve further rotates until, all orifices 14 being exposed, it begins to expose the connection between the bore 12 and the high-pressure channel 7 (or the complementary orifices 33 and 34), thus connecting the high pressure of the first pinion wheel and the low pressure orifice.

At that time the check-valve 11 closes and the delivery of the half-compressor corresponding to the first pinion wheel is then completely cancelled.

If the delivery remains still too high, the pressure continues to increase and the pilot valve causes the pressure in the jack 35 to be increased; the rack 36 reaches the stop 41; for instance the jack and the springs can be so determined that the complete extension of the rack 36 takes place from 7 to 7,4 bar and that of the rack 37 starts at 7,6 bar and ends at 8 bar.

When pressure exceeds 7,6 bar, the auxiliary orifices pertaining to the second pinion wheel are sequentially opened in the same manner as those pertaining to the first pinion wheel.

However, a connection is not necessary between the high pressure orifice of the second pinion wheel and the low pressure orifice as is the case for the first pinion wheel. It is sufficient to arrange, at the end of the travel of the rack 37, that all auxiliary orifices are connected with the low pressure orifice but that the high pressure orifice remain isolated from low pressure and that an auxiliary pilot valve commands the closing of a valve (not shown) located at the intake of the compressor, which throttles this intake and thus provides a zero delivery.

This solution, known in the case of twin screw compressors, leads, in the case of this invention applied to single screw compressors with two pinion wheels, to the results which will now be described with reference to FIG. 6.

In FIG. 6, the power consumed by the compressor, measured as a percentage of full load power, is plotted (as ordinate) as a function of the delivery (as abscissa) which is expressed as a percentage of full delivery.

The diagonal 43 represents the ideal objective where power consumed and delivery are proportional to each other.

The curve 44 represents the result obtained with a screw compressor, the control of which is obtained by intake throttling. The curve 45 represents the result obtained with a twin screw compressor provided with a turn valve as described in U.S. Pat. No. 3,088,658 or with a single screw compressor provided with two turn valves as described hereinabove but which would be opened simultaneously. The curve 46 represents the result obtained when operating in sequence according to the present invention.

The deliveries and powers obtained by throttling the intake after complete opening of the turn valves are shown in dotted lines 47 and 48.

It shall be noted that the minimum delivery obtained without throttling the intake is approximately 20 to 25% of full delivery in the case of curve 45 whilst it drops to 10–15% in the case of applying the invention.

Attention is drawn to the considerable gain in part load power obtained by the sequential use of the turn valves, this gain being to a large extent caused by the de facto change in compression ratio due to the fact that compression is cancelled in one half compressor but also to the simultaneous elimination of the leaks pertaining to this half compressor.

The result is a considerable power gain for all deliveries below 50%, as this gain is between 10 and 30% of the power consumed under these operating conditions.

This gain is obtained by applying a non-symmetrical thrust on the screw, but a very moderate thrust as, for a screw of 240 mm diameter delivering 13 $m^3$/minute at 3000 rpm, it is of the order of magnitude of 4000 Newton, and the stress to be taken by the bearing 10 is of the order of magnitude of the tension created by a pulley-and-belt drive.

It is possible to let the two turn valves have a limited overlap in their operative ranges and for instance to design the springs so that the rack 36 terminates its travel at 7,6 bar whilst the rack 37 begins its own one at 7,4 bar; this results in a decrease of the delivery value for which the compression of the first pinion wheel is cancelled, as shown on the dotted curve 49.

It can also be advantageous to stop the liquid injection pertaining to the first pinion wheel when the first pinion does no longer deliver any flow, as this results in a power gain of a few percent.

In a preferred embodiment of the invention, the turn valve pertaining to the second pinion wheel allows, at the end of its rotation, a connection of the high pressure orifice with the low pressure orifice in the same way as described for the first pinion wheel. The aforementioned device for throttling the intake is replaced by a check valve inserted downstream of the compressor, between the compressor and the user device, and, in the case of compressor using cylindrical screws, a device capable of stopping the injection a few seconds before the turn valve pertaining to the second pinion wheel connects the high and the low pressure. This is for instance obtained by limiting at 5 bar the pressure transmitted by the pilot valve 101 into the jack 35, by means of said pneumatic lock 102 providing that at such pressure the turn valve has connected all auxiliary orifices pertaining to the second pinion wheel with the low pressure, except the high pressure orifice, and providing a second pilot valve 103 (FIG. 4) that, when the limiting pressure of 8 bar is attained at compressor discharge, sends this pressure first to a valve 104 that cuts the liquid injection line 105 and then through a pneumatic delay device 106 to the jack 35 which finishes its travel and connects the high pressure of the second pinion wheel with the low pressure.

Provided the clear sections of the auxiliary orifices and of the connections between high and low pressure are so designed that the speeds—for the gas compressed by the screw and returned to intake—are moderate and preferably equal to or below 40 meters/second, the operating sequence consisting in stopping the injection and, a few seconds later, suppressing all compression results in decreasing the power of the compressor at zero delivery to some percent as shown on the dotted line 50 in FIG. 6.

It should be noted nevertheless that, in the case of compressors using flat screws or conical screws such as shown in U.S. Pat. No. 3,180,565 FIG. 6 or in U.S. Pat. No. 3,551,082, stopping injection and suppressing compression can be achieved at the same time; the injected liquid is centrifugated outside of the screw and does not return as it would in case of cylindrical screws.

The curve 50 is a fictitious line obtained by joining the point 51 representing the values obtained prior to connecting high and low pressure, and point 52 representing the values obtained after such connection; indeed there exists no stable position between these two positions and for the intermediate deliveries the compressor must "hunt" and shift its control from one position to the other. But this hunting, which depends in a known manner upon the ratio between the delivery of the compressor whilst in position 51 and the buffer tanks is the more reduced as the delivery of the compressor has been reduced by sequential elimination of the delivery of one half compressor.

Referring to FIGS. 7, 8 and 9 an alternative embodiment of the invention will now be described.

The compressor of FIGS. 1 and 2 has been maintained, but the turn valve device has been suppressed and replaced by a series of channels such as 53, 54 and 55 connecting holes provided in the casing such as 56 or 57 or the exhaust channel 7 to the intake orifice 5 via passages such as 58. The outline of the outlet of the orifice 57 in the bore of the casing where the screw rotates is inscribed within the width of the top of a thread according to the teaching of French Pat. No. 2177171, in order to avoid connecting two successive threads.

Each channel such as 54 extends as a bore 59 in which a piston 60 can slide. This piston has a shoulder 61 that is pressed against the face 62 by a spring 63. A channel 64 can bring sealing liquid or gas under pressure between face 62 and shoulder 61. A hole 76 equalizes pressure between the chamber containing the spring and the low pressure.

The operation of the device shall now be described in the case of an air compressor provided with an injection means of auxiliary liquid that is, in a known way, separated from the compressed air and then re-injected. A pilot valve 65 opens when the discharge pressure of the compressor exceeds a preset value, say 7 bar, and sends compressed air into a jack 66 provided with a calibrated leak orifice 67. When the delivery of the pilot valve 65 increases, the pressure on the piston 68 of the jack increases, thus compressing the spring 69. And the jack actuates the piston 70 of a multiway hydraulic valve supplied in 71 with pressurized liquid taken in the compressed air tank and the displacement now brings the hydraulic pressure on the outlets 72, 73, 74, 75... which are in turn connected to pipings such as 59 which respectively feed the pistons of channels 53, 54, 55, etc.

This results in these pistons moving and connecting the orifices such as 57 with the low pressure.

By arranging these channels in such a way that at any moment a thread may communicate with one channel—for example as described in French Pat. No. 2177171 by using at least 3 channels per side in the case of a compressor using a 6-threaded screw, whereby one of the channels is connected to the high pressure orifice—the delivery provided by one pinion wheel can be by approximately one third by acting on the piston obturating the channel 53, then by a second third by moving the piston obturating the channel 54, then totally by acting on the piston obturating channel 55.

One can even continue diminishing the compressor delivery below 50% by lifting in sequence the piston obturating the channels 77 and 78.

Thus, by use of independent obturators actuated by oleo-pneumatic means, dispensing from the mechanical turn-valve pneumatically activated of the example of FIGS. 1 to 5, the delivery of the compressor can be reduced step by step down to 10–15% if the high pressure orifice pertaining to the second pinion wheel is not connected with the low pressure or even down to zero if the piston controlling the passage 79 between the high pressure orifice of the second pinion wheel and the low pressure is activated.

The piston 60 has a certain clearance in its bore, and as soon as pressure is taken away from channel 59 it is brought back to position by the spring. But by providing a convenient arrangement, the piston 70 can progressively expose the openings 72, 73, etc. . . . and thus, taking into account the leaks around the piston there may appear under the shoulder 61 a pressure varying according to the position of the piston 70, such position resulting in the piston unmasking more or less the orifice 57, this leading to let more or less air under compression in the thread and thus associating a continuously variable position of the pilot valve 65 and a continuously variable delivery of the compressor and not only a delivery varying from 100% to 0% in 6—or more—discrete steps.

Although the device is different, the process remains finally the same as in the first example given, with the same advantages, since, to control the compressor, it consists of sequentially opening the auxiliary orifices pertaining to a pinion wheel, then of connecting the corresponding high pressure orifice with the low pressure before sequentially opening the auxiliary orifices pertaining to the second pinion wheel. The efficiency gains described with reference to FIG. 6 remain the same and by interrupting the injection a few seconds before opening the channel 79, in the case of cylindrical screws, the power of the compressor can be reduced to some percent.

It must be remarked that, in the two examples cited, this interruption of a few seconds is sufficient to eliminate the liquid from the compressor and lower the power to values that are usually below 5% of full load power, but that it remains sufficiently short to avoid the situation wherein, in the period where there is no more injection, the compressor runs hot and seizes.

I claim:

1. A process to control the delivery of single screw compressors or expansion machines of the type including a screw co-operating with at least two pinion wheels and rotatable inside a casing provided with at least one low pressure orifice and with high pressure orifices located near said pinion wheels, at least one channel to connect the high pressure orifice pertaining to one of the pinion wheels, called first pinion, and the low pressure orifice, such channel being provided with an obturating means, auxiliary orifices arranged in the casing connecting the various zones of the casing exposed to pressure with the low pressure orifice, said auxiliary orifices being provided with obturating devices, such process comprising sequentially opening these orifices to diminish the delivered volume, starting from the orifices located at the lowest pressure and progressing towards the orifices at the higher pressure, the process including the hierarchy of steps wherein, in order to reduce the delivery of the compressor or expansion machine from a maximum delivery, the auxiliary orifices pertaining to the first pinion are first sequentially opened; if then the measured delivery is still too high the device obturating the channel connecting the high pressure orifice of the first pinion and the low pressure orifice is opened secondly; and if then the delivery obtained is still too high the auxiliary orifices pertaining to the second pinion are finally sequentially opened.

2. A process according to claim 1, wherein said compressor or expansion machine is provided with an injection means for injecting auxiliary liquid, wherein the high pressure orifice pertaining to the second pinion is also connected to the low pressure orifice via an obturating device, wherein the liquid injection means has at least one stopping device, the process including the further steps wherein, if the delivery obtained after all auxiliary orifices have been opened is yet too high, the injection is stopped and the obturating device connecting the high pressure orifice of the second pinion and the low pressure orifice is opened.

3. A process according to claim 1, wherein said compressor or expansion machine is provided with a cylindrical screw and with an injection means for injecting auxiliary liquid, wherein the high pressure orifice pertaining to the second pinion is also connected to the low pressure orifice via an obturating device, wherein the liquid injection means has at least one stopping device, the process including the further steps wherein, if the delivery obtained after all auxiliary orifices have been opened is yet too high, the injection is stopped and then, after a time delay, the obturating device connecting the high pressure orifice of the second pinion and the low pressure orifice is opened.

* * * * *